US005392469A

United States Patent [19]

Adams

[11] Patent Number: 5,392,469

[45] Date of Patent: Feb. 28, 1995

[54] SEAT COVER

[76] Inventor: James L. Adams, 37 Fremont Dr., Fargo, N. Dak. 58103

[21] Appl. No.: 148,296

[22] Filed: Nov. 8, 1993

[51] Int. Cl.[6] ..... A47K 13/14

[52] U.S. Cl. ..... 4/245.2; 4/245.4; 4/245.5

[58] Field of Search ..... 4/245.1, 245.2, 245.3, 4/245.4, 245.5, 245.6, 245.7, 245.8, 245.9

[56] References Cited

U.S. PATENT DOCUMENTS

| | | | |
|---|---|---|---|
| 1,077,277 | 11/1913 | Holmes | 4/245.3 |
| 1,108,460 | 8/1914 | Mesick et al. | 4/245.8 |
| 1,761,391 | 6/1930 | Harris | 4/245.3 |
| 2,093,168 | 9/1937 | Hamer | 4/245.2 |
| 2,302,317 | 11/1942 | Henry | 4/245.3 |
| 2,312,589 | 3/1943 | Reeves | 4/245.3 |
| 4,875,242 | 10/1989 | Albrecht et al. | 4/245.4 |
| 4,935,969 | 6/1990 | Farnsworth | 4/245.4 |

FOREIGN PATENT DOCUMENTS

| | | | |
|---|---|---|---|
| 2631225 | 11/1989 | France | 4/245.1 |
| 416033 | 7/1925 | Germany | 4/245.3 |
| 1387994 | 3/1975 | United Kingdom | 4/245.1 |
| 1600786 | 10/1981 | United Kingdom | 4/245.1 |
| 2182688 | 5/1987 | United Kingdom | 4/245.3 |

*Primary Examiner*—Henry J. Recla
*Assistant Examiner*—Charles R. Eloshway
*Attorney, Agent, or Firm*—Burd, Bartz & Gutenkauf

[57] ABSTRACT

A cover for a toilet seat is a one-piece sheet member having side, front and rear sections surrounding an opening aligned with a toilet seat opening when the cover is placed on the toilet seat to protect a person from contaminants. The front of the cover has a rearwardly open pocket to accommodate the front of the toilet seat. An adhesive on the rear section of the sheet member is releasably attached to the toilet seat to retain the sheet member on the toilet seat with the front of the toilet seat located within the pocket.

22 Claims, 3 Drawing Sheets

SEAT COVER

BACKGROUND OF THE INVENTION

The invention is in the art of protective covers for structures that are normally engaged with a part of a person's body to shield the body from foreign materials and contaminants that may be on the structures. The protective cover is a seat cover for a toilet seat used to shield a person from contaminants such as bacteria, viruses and parasites that may be on the toilet seat.

BACKGROUND OF THE INVENTION

Sanitary protection products are used by humans to protect the person's body from being contaminated with foreign materials and contaminants that may be hazardous to health. Protective clothing, gloves and shields are worn by a person to guard against contaminants, particulates, and foreign materials that may be present in the environment in which the person works and lives. The necessities of life expose persons away from home to contaminants when using public restrooms and the toilets therein. Paper seat covers have been developed for use with conventional toilet seats to insulate a person from the foreign materials and contaminants thereon. These covers are generally flat oval-shaped paper products that are adapted to rest on top of the toilet seats. The paper toilet seat covers do not have structures that retain the seat covers on the toilet seats. The result is that these covers can slip and move off the toilet seats before a person can be properly seated thereby exposing the person directly to the foreign materials and contaminants on the seat.

SUMMARY OF THE INVENTION

The invention relates to protective covers for structures having openings useable as human body supports to shield the body from foreign matter and contaminants located on the structures. The cover is flexible and foldable sheet material, such as sheet plastic or paper, having opposite side sections joined to transverse front and rear sections, all of which surround a generally central opening. A front panel joined to the front section forms a rearwardly open pocket that accommodates a front section of the support. Retaining structures, such as an adhesive, secured to the sheet material is releasably attached to the structure to hold the sheet material on the structure and maintain the front section of the structure within the pocket thereby holding the sheet material on the structure. Additional shielding of the body from the structure and parts adjacent the structure is provided with generally transverse flaps connected to the front panel and the rear section of the sheet material. The flaps can be folded up or down to cover the relevant structures. Members secured to the front flaps maintain the flaps in downward directions and prevent the cover from being flushed down a conventional toilet bowl.

The preferred embodiment of the seat cover of the invention is used with a toilet seat having a front portion and side members joined to the back section and a generally central opening between the side members to accommodate the lower body and legs of a human in a seated position. The cover comprises sheet material that is of a size to cover the toilet seat and protect the person using the toilet seat. The sheet material has side sections that cover the side members of the seat and a rear section joined to the side members and covering the back section of the seat. A first flap on the front section of the sheet material extends toward the central opening. The first flap has opposite sides releasably attached to the front section, whereby the opposite sides of the first flap can be separated from the front section allowing the first flap to extend downwardly over the inside of the toilet seat. The front section of the sheet material joined to the side sections is connected to a front panel that extends rearwardly below the front section and forming therewith a generally transverse pocket for accommodating the front portion of the toilet seat. The front panel has outwardly and rearwardly extended opposite edges that are secured with heat seals to outwardly and rearwardly extend opposite edges of the front section of the sheet means to close the sides of the pocket and prevent lateral shifting or movement of the sheet material relative to the toilet seat. An adhesive secured to the rear section of the sheet material releasably retains the sheet material on the toilet seat with the front portion of the toilet seat located in the pocket. The adhesive is normally covered with a removable sheet which protects the adhesive during storage until the cover is ready to be used. The opening in the sheet material is smaller than the central opening in the toilet seat. Another form of the opening has a generally keyhole shape. Another form of the opening has a generally oval shape. Additional shielding of the body is provided with a downwardly directed-transverse second flap joined to the front panel. The flaps cover structures adjacent the toilet seats that can contaminate the body and parts of a person. A transverse semi-rigid plastic strip is attached to the second flap to retain the second flap in the down position when the seat cover is on the toilet seat. The strip also prevents the seat cover from being flushed down a conventional toilet bowl.

The seat covers for the toilet seat are a low cost, waterproof, washable or disposable compact shield that can be carried in pockets or purses for suitable protection when needed. The cover is preferably made of plastic materials such as polyethylene film. Other types of materials, including paper and biodegradable plastics, can be used for the cover.

DESCRIPTION OF PREFERRED EMBODIMENTS

Figure 1:
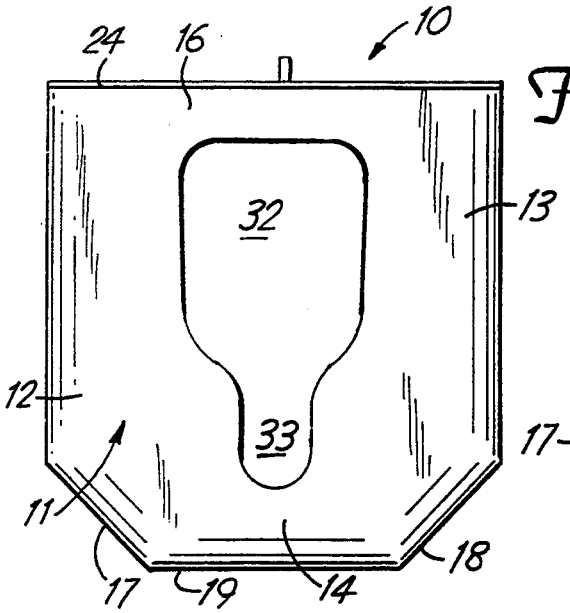
FIG. 1 is a top plan view of the seat cover for a toilet seat of the invention.
Figure 2:
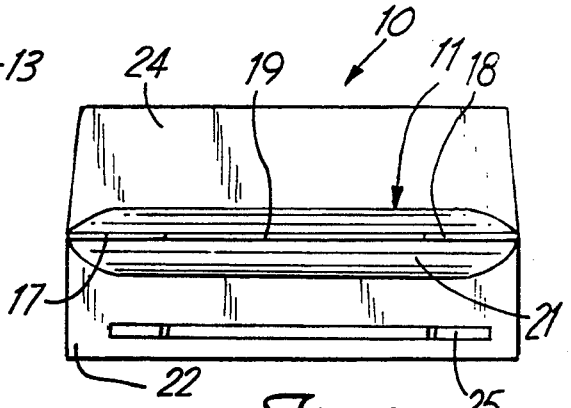
FIG. 2 is a front elevational view thereof.

Referring to FIG. 1, there is shown a top plan view of a seat cover, indicated generally at 10, for a water closet or toilet seat. The toilet seat 31 is a conventional oval or U-shaped seat hinged to toilet bowl 30. Covers for closing the opening of the seat can also be hinged to the toilet bowls. Toilet seat 31 has side members joined to a rear member forming seat opening 34. The side members have front sections that can be separated or joined together. The structure of the conventional toilet seat is incorporated herein by reference. Cover 10 is used as a shield to insulate the body, legs and other body parts, as well as clothing of a person from contaminants and foreign materials that are found on toilet seat 31 and adjacent structures. The contaminants can include bacteria, viruses, fungi, parasites and like germs and organisms that can be a death hazard. Cover 10 can be made from waterproof material, such as plastic film and paper, which can be recycled after use. Cover 10 can be used with supports and other structures to provide a barrier between the body of a person and the support or structure accommodating the cover.

Cover 10 has a generally rectangular body of sheet material or film, indicated generally at 11, having longitudinal side sections 12 and 13, and a transverse front section 14 joined to side sections 12 and 13. The rear portion of body 11 has a transverse rear section 16 joined to side sections 12 and 13. Sections 12, 13, 14 and 16 surround a generally keyhole-shaped centered opening 32 having a forwardly directed longitudinal neck 33. Body 11 can have alternative-shaped generally central openings.

Figure 3:
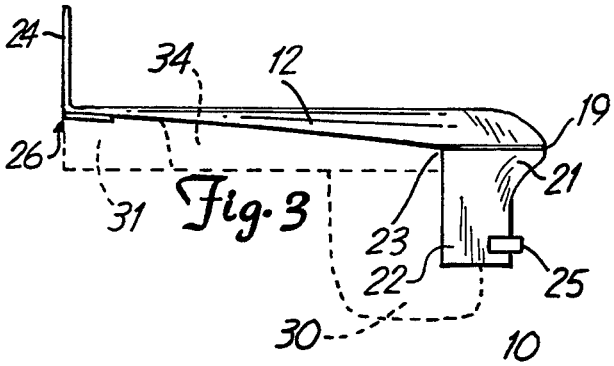
FIG. 3 is a side elevational view thereof.
Figure 4:
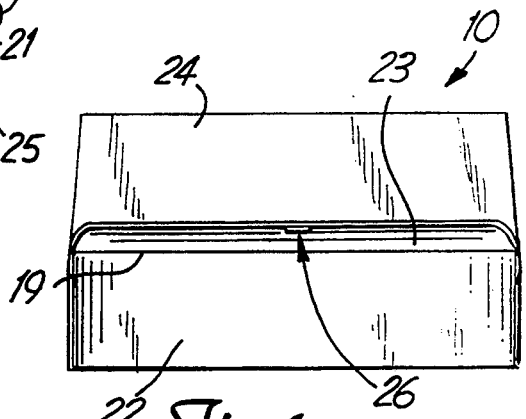
FIG. 4 is a rear elevational view thereof.
Figure 5:
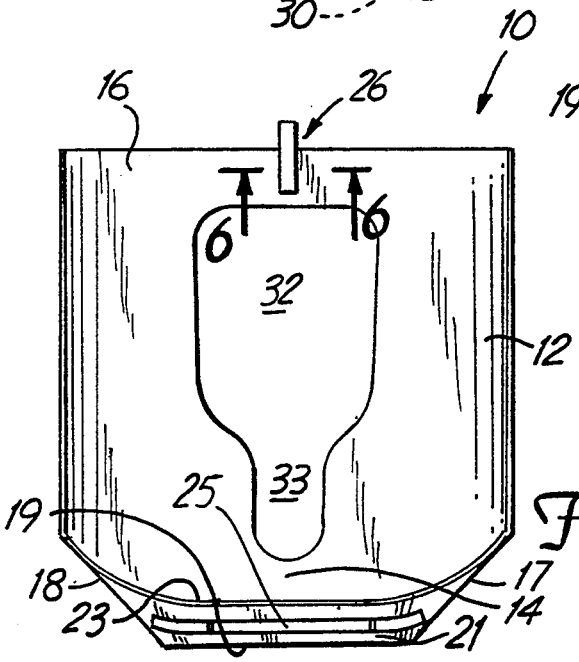
FIG. 5 is a bottom plan view thereof.

Front section 14 has a transverse front edge 19 that joins to rearwardly and outwardly directed corners or edges 17 and 18. Front edge 19 is a folded portion of front section 14. Edges 17 and 18 are heat-sealed seams joined to opposite edges of front section 14 and a lower or bottom panel 21. Panel 21 extends rearwardly from front edge 19 below front section 14 and is joined to a downwardly directed flap or flange 22. Flap 22, along with front section 14, forms a transverse pocket 23 for accommodating the forward portion of seat 31, as shown in broken lines in FIG. 3.

A flat transverse semi-rigid member 25 is secured to the front of flap 22. An adhesive or other bonding material is used to connect member 25 to the front of the plastic of flap 22. Member 25 is a plastic strip having fold or life hinge sections to allow member 25 to be folded within cover 10. Member 25 is a transverse weight that retains flap 22 in the down position when cover 10 is located on toilet seat 31. The long, semi-rigid member 25 prevents seat cover 10 from being flushed down a conventional toilet bowl.

Rear section 16 of body 11 is joined to an upwardly directed flap or flange 24 that extends transversely across the full length of body 11. Flap 24 is adapted to be placed against a raised conventional toilet seat cover, water tank or other structures located rearwardly of the seat. Flap 24 can be draped over parts of the toilet located behind the toilet seat.

The midsection of the lower side of rear section 16 has an adhesive or fastening strip, indicated generally at 26, to releasably connect rear section 16 of body 11 to a rear portion of seat 31. Adhesive strip 26 retains cover 10 on seat 31 as it holds the forward portion of cover 10 in embracing relation with seat 31 and prevents lateral or sideways slipping of cover 10 relative to seat 31. The rearwardly directed corner edges 17 and 18 prevent the front of cover 10 from moving laterally on seat 10. Adhesive 26 also prevents cover 10 from moving forward off of seat 31.

Figure 6:
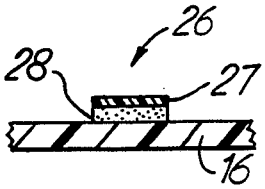
FIG. 6 is an enlarged sectional view taken along the line 6—6 of FIG. 5.
Figure 7:
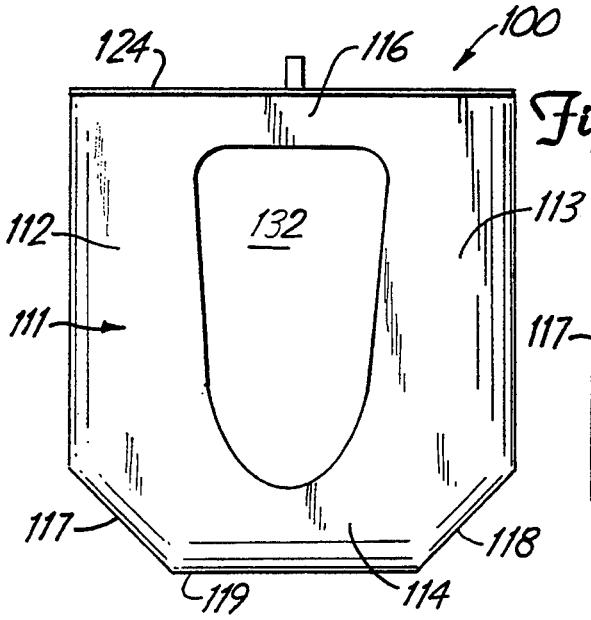
FIG. 7 is a top plan view of a modification of the seat cover for a toilet seat of the invention.
Figure 8:
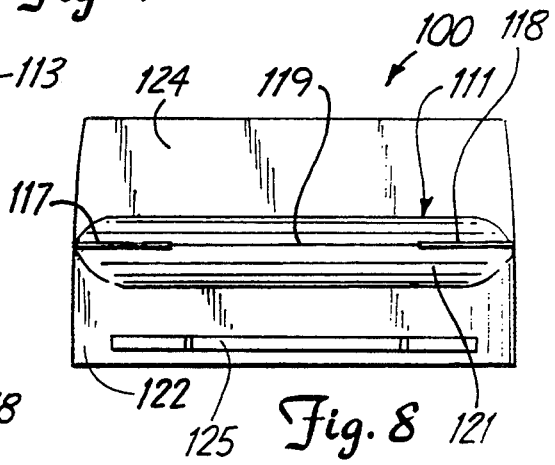
FIG. 8 is a front elevational view of FIG. 7.

Referring to FIG. 6, adhesive strip 26 has a longitudinal plastic adhesive layer 28 that is attached to the bottom of rear section 16. The plastic adhesive layer is a pressure-responsive adhesive 28 which is adapted to releasably adhere to seat 31. A removable cover sheet 27 is located over adhesive layer 28 to protect the adhesive during storage and transportation of the cover. Cover sheet 27 has a free end or tab that can be gripped by a person to remove the cover sheet from the adhesive. Other types of releasable fasteners can be used to attach body 11 to seat 31. For example, a releasable high tack or low tack adhesive tape can be secured directly to the plastic of section 16. A removable cover sheet can enclose this adhesive. An example of a suitable tape is 3M Tape No. F9415, made by the 3M Company of St. Paul, Minn. In use, cover sheet 27 is removed so that adhesive layer 28 can be placed in direct contact with the rear portion of seat 31, thereby securing cover 10 to seat 31.

Referring to FIGS. 7–12, there is shown a modification of the cover for a toilet seat 131 for toilet bowl 130, indicated generally at 100. The parts of cover 100 that correspond with the parts of cover 10 have the same reference numerals with the prefix "1".

Cover 100 has a generally rectangular body 111 of sheet material including longitudinal side sections 112 and 113, transverse front section 114 and a transverse rear section 116, joined to side sections 112 and 113. The forward portion of front section 114 has a transverse front edge 119, and rearwardly and outwardly directed opposite corners or edges 117 and 118. Corners 117 and 118 are heat seals that join a bottom panel 121 to front section 114, thereby forming an inwardly directed pocket 123. Edge 119 is a folded portion of front section 114 of body 111. Bottom panel 121 is joined to a downwardly directed flap or flange 122 which extends downwardly from the forward edge of seat 131. The rear edge of rear section 116 is joined to an upwardly directed flap or flange 124

A flat, transverse semi-rigid plastic member 125 is secured to the front of flap 122. An adhesive or other bonding material is used to connect member 125 to the front of the plastic flap 122. Member 125 is a plastic strip having a fold or live hinge sections to allow member 125 to be folded within cover 100. Member 125 is a transverse weight that retains flap 122 in the down position when cover 100 is located on toilet seat 131. The long, semi-rigid member 125 also prevents seat cover 100 from being flushed down a conventional toilet bowl.

Figure 9:
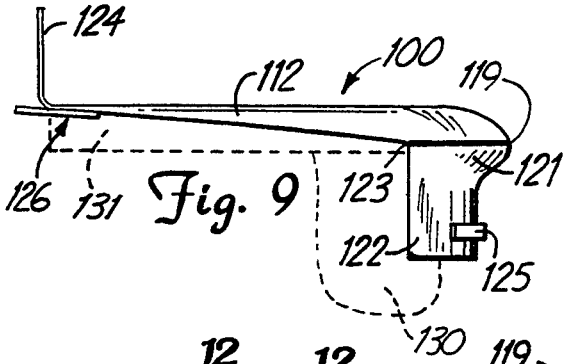
FIG. 9 is a side elevational view of FIG. 7.
Figure 10:
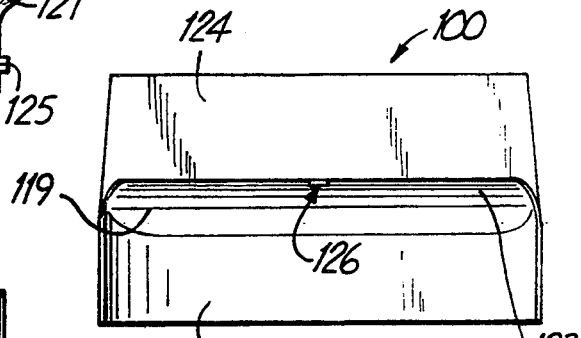
FIG. 10 is a rear elevational view of FIG. 7.
Figure 11:
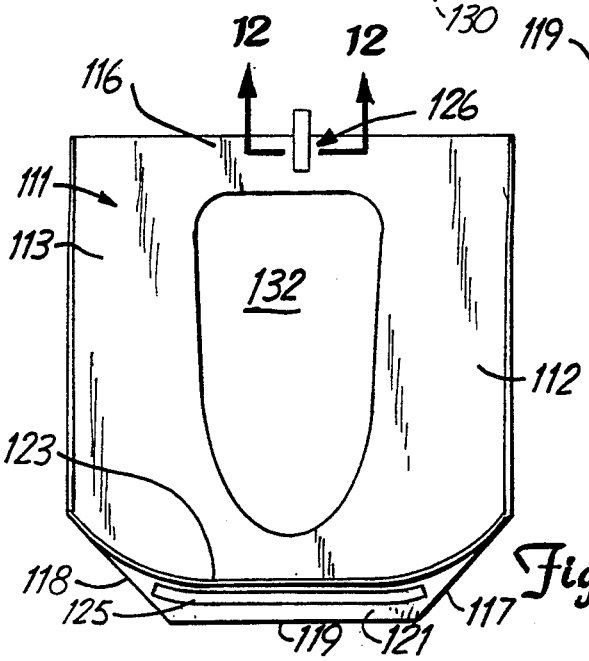
FIG. 11 is a bottom plan view of FIG. 7.

A releasable fastener, indicated generally at 126, is secured to the midsection of the bottom of rear section 116, as seen in FIGS. 10 and 11. Releasable fastener 126 is preferably an adhesive strip that can be releasably attached to the rear section of seat 131, as seen in FIG. 9.

Figure 12:
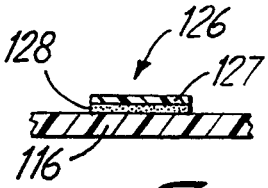
FIG. 12 is an enlarged sectional view taken along the line 12—12 of FIG. 11.

Referring to FIG. 12, there is shown one type of adhesive strip, indicated generally at 126, having a plastic adhesive layer 128 for attaching strip 126 to rear section 116. The adhesive layer is a pressure-responsive adhesive 128 that is normally covered with a removable cover sheet 127. Cover sheet 127 has a free end that can be gripped so that sheet 127 can be stripped from adhesive 128. Adhesive 128 can be applied to the rear portion of seat 131 to attach cover 100 to cover 131.

Figure 13:
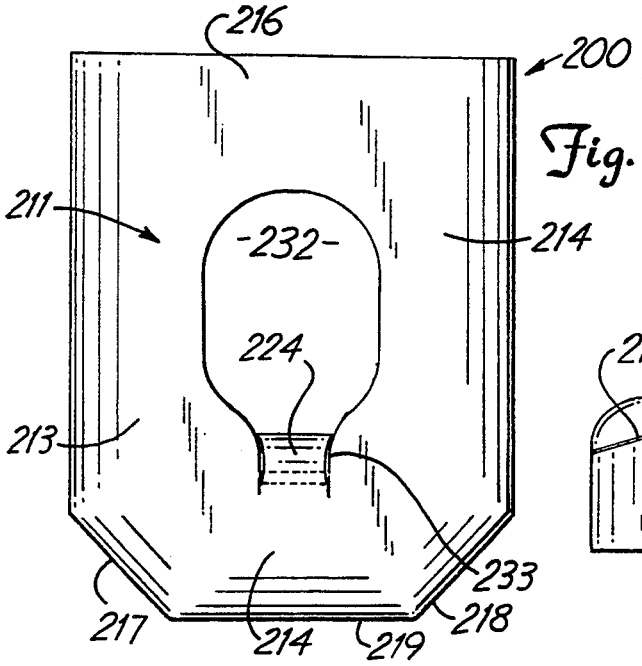
FIG. 13 is a top plan view of a second modification of the seat cover for a toilet seat of the invention.
Figure 14:
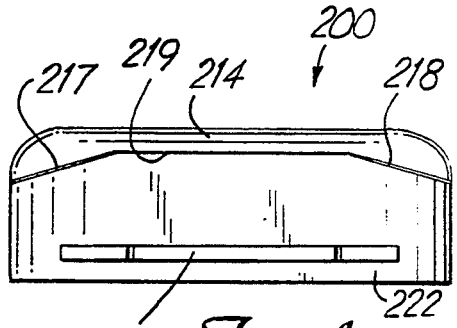
FIG. 14 is a front elevational view of FIG. 13.

Referring to FIG. 13, there is shown a top plan view of a second modification of a seat cover, indicated generally at 200, for water closet or toilet seat 231 mounted on a toilet bowl 230. Toilet seat 231 is a conventional oval or U-shaped seat hinged to toilet bowl 230. Toilet seat 231 has side members joined to a rear member forming the seat opening. The side members have front sections that can be separated or joined together. The structure of the conventional toilet seat is incorporated herein by reference.

Cover 200 is used as a shield to insulate the body, legs and other body parts, as well as clothing of a person from contaminants and foreign materials that are found on the toilet seat 231, within the toilet bowl and adjacent structures. The contaminants can include bacteria, viruses, fungi, parasites and like germs and organisms that can be a death hazard. Cover 200 can be made from waterproof material, such as plastic film and paper, which can be recycled after use. Cover 200 can be used with supports and other structures to provide a barrier between the body of a person and the support or structure accommodating the cover.

Cover 200 has a generally rectangular body of sheet material or film, indicated generally at 211, having longitudinal side sections 212 and 213, and a transverse front section 214 joined to side sections 212 and 213. The rear portion of body 211 has a transverse rear section 216 joined to side sections 212 and 213. Sections 212, 213,214 and 216 surround a generally keyhole-shaped centered opening 232 having a forwardly directed longitudinal neck 233. A first flap 224 is located in the neck 233. Flap 224 is releasably connected to side members 213 and 214. Body 11 can have alternative-shaped generally central openings.

Figure 15:
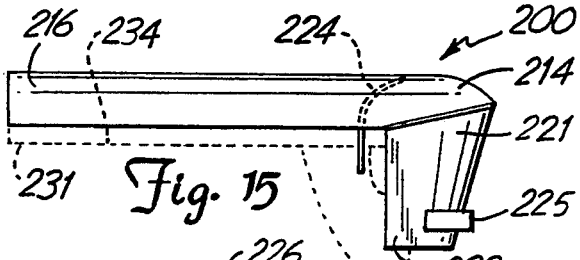
FIG. 15 is a side elevational view of FIG. 13.
Figure 17:
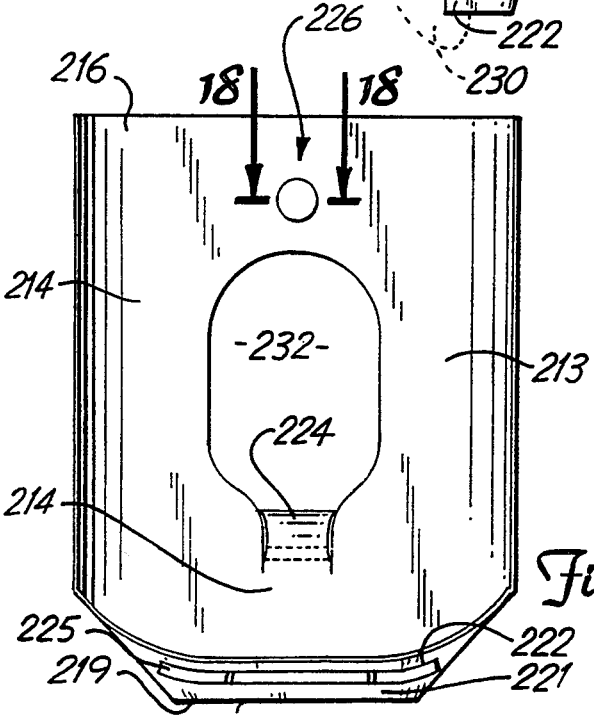
FIG. 17 is a bottom plan view of FIG. 13.
Figure 16:
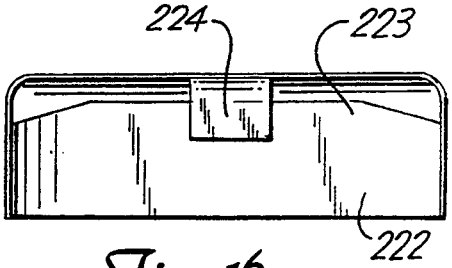
FIG. 16 is a rear elevational view of FIG. 13.

Front section 214 has a transverse front edge 219 that joins to rearwardly and outwardly directed corners or edges 217 and 218. Front edge 219 is a folded portion of front section 213. Edges 217 and 218 are heat-sealed seams joined to opposite edges of front section 214 and a lower or bottom panel 221. Panel 221 extends rearwardly from the front edge 219 below front section 214 and is jointed to a downwardly directed second flap or flange 222. Flap 222, along with front section 214, form a transverse pocket 223 for accommodating the forward portion of seat 231, as shown in broken lines in FIG. 15.

A flat, transverse semi-rigid plastic member 225 is secured to the front of flap 222. An adhesive or other bonding material is used to connect member 225 to the front of the plastic of flap 222. Member 225 is a plastic strip having fold or life hinge sections to allow member 225 to be folded within cover 200. Member 225 is a transverse weight that retains flap 222 in the down position when cover 200 is located on toilet seat 231. The long, semi-rigid member 225 also prevents seat cover 200 from being flushed down a conventional toilet bowl.

Front section 214 of body 211 is joined to first flap or flange 224 that is releasably connected to side members 213 and 214. Opposite sides of flap 224 are partly cut or separated from members 213 and 214, so that flap 224 can be separated from members 213 and 214, and folded down over the inside of seat 231 into the toilet bowl, as shown in broken lines in FIG. 15.

The midsection of the lower side of rear section 216 has an adhesive or fastening member, indicated generally at 226, to releasably connect rear section 216 of body 211 to a rear portion of seat 231. Adhesive member 226 retains cover 200 on seat 231 as it holds the forward portion of cover 200 in embracing relation with seat 231 and prevents lateral or sideways slipping of cover 200 relative to seat 231. The rearwardly directed corner edges 217 and 218 prevent the front of cover 200 from moving laterally on seat 231. Adhesive 226 also prevents cover 200 from moving forward off of seat 231.

Figure 18:
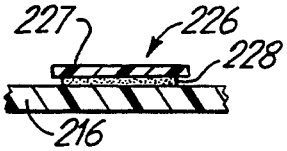
FIG. 18 is an enlarged sectional view taken along the line 18—18 of FIG. 17.

Referring to FIG. 18, adhesive strip 226 has a longitudinal plastic adhesive layer 228 that is attached to the bottom of rear section 216. The plastic adhesive layer is a pressure-responsive adhesive 228 which is adapted to releasably adhere to seat 231. A removable cover sheet 227 is located over adhesive layer 228 to protect the adhesive during storage and transportation of the cover. Cover sheet 227 has free edges that can be gripped by a person to remove cover sheet 227 from adhesive 228. Other types of releasable fasteners can be used to attach body 211 to seat 231.

Covers 10, 100 and 200 are made from a single sheet of plastic film. V-shaped notches are cut in the side sections of the film to form the chamfered or tapered corners 17, 18, 117, 118, 127 and 128. The adjacent edges forming the corners are heat-sealed together to form pockets 23, 123 and 223. The keyhole-shaped openings 32 and 232 or the oval opening 132 is cut into the midportion of body 111. Flaps 22, 122, 24 and 124 are joined to bottom panels 21 and 121, and rear sections 16 and 116 with fold lines. The material of the cover can be a low density polyethylene film, a linear low density polyethylene film or mild density polyethylene film. Other types of plastics or materials can be used for the covers. For example, the covers can be biodegradable paper and biodegradable plastics.

In use, covers 10, 100 and 200 are placed on top of the toilet seat with openings 32,132 and 232 aligned with the openings in the toilet seats. The front portions of the covers are slipped over the forward parts of the toilet seats thereby locating the forward portions of the toilet seats in pockets 23, 123, and 223. The corner sections 17, 18, 117, 118, 217 and 218 of the covers prevent lateral movement or slipping of the covers off of the front of the toilet seats. The cover sheets 27, 127 and 227 are removed so that the rear portions of the cover can be adhesively attached to the rear portion of the toilet seats. This prevents longitudinal as well as lateral movements of the covers relative to the toilet seats. Front flaps 22, 122 and 222 extend downwardly from the front portion of the toilet seats in front of the bowls. Members 25, 125 and 225 retain the front flaps in the down position and prevent the used covers from being flushed down the toilet bowl. The rear flaps 25 and 125 extend upwardly and rest on the inside of the open conventional toilet seats, the water closets or other structures that may be located rearwardly from the toilet seat. Covers 10, 100 and 200 are readily removed from the toilet seat. The user merely grips flaps 24, 124 and 224 and pulls the covers from the seats and appropriately disposes of the used covers. The plastic covers are not flushed with the toilet water.

While there has been shown and described preferred embodiments of the seat cover for use with conventional toilet seats, it is understood that changes in the structure, materials and shape of the cover can be made by those skilled in the art without departing from the invention. The invention is defined in the following claims.

I claim:

1. A cover for a toilet seat mounted on a toilet bowl, said seat having a front portion, side members joined to a back section and a generally central opening between the side members to accommodate the lower body and legs of a human comprising: sheet means for covering the toilet seat and front of the toilet bowl to protect the person using the toilet seat, said sheet means having side sections for covering the side members of a toilet seat, a rear section joined to the side sections and covering the back section of a toilet seat, a front section joined to the side sections, said side, rear and front sections surrounding an opening, a front panel joined to the front section extended rearwardly below the front section, said front panel having outwardly and rearwardly extending opposite edges joined to outwardly and rearwardly extending opposite edges of the front section forming with the front section and front panel a rearwardly open pocket to accommodate the front portion of the toilet seat, a downwardly extending imperforate transverse flap joined to the front panel, said flap having a downward length to locate the flap adjacent the front of the toilet bowl to protect a person's legs and clothing from the toilet bowl, and adhesive means secured to the sheet means to releasably retain the sheet means on the toilet seat with the front portion of the toilet seat located within said pocket and the flap extending downwardly adjacent the front of the toilet bowl.

2. The cover of claim i wherein: the sheet means is a one-piece plastic sheet.

3. The cover of claim 2 wherein: the opposite edges of the front panel and front section are heat-sealed together.

4. The cover of claim 1 wherein: the adhesive means includes an adhesive means secured to the rear section and cover means located over the adhesive means, said cover means being removable from the adhesive means whereby the adhesive means can be placed in contact with the back section of the toilet seat.

5. The cover of claim 1 wherein: the opening in the sheet means is smaller than the central opening of the toilet seat.

6. The cover of claim 1 wherein: the opening in the sheet means has a longitudinal generally keyhole shape.

7. The cover of claim 1 wherein: the opening in the sheet means has a generally ovaloid shape.

8. The cover of claim 1 including: a transverse member secured to the flap of a size to prevent the cover from being flushed down a conventional toilet bowl.

9. The cover of claim 1 including: a second flap joined to the front section and releasably connected to the side sections adapted to extend downwardly over an inside of the toilet seat into an associated toilet bowl.

10. The cover of claim 9 including: transverse means secured to the sheet means of a size to prevent the cover from being flushed down the associated toilet bowl.

11. The cover of claim 1 including: an upwardly directed transverse flap joined to the rear section.

12. A cover for a toilet seat mounted on a toilet bowl, said seat having side members and a generally central opening comprising: a sheet member having a side section, a front section and a rear section surrounding an opening, said side sections being of a size to cover the side members of the toilet seat, and a front panel joined to the front section extending below the front section, said front panel having outwardly and rearwardly extending opposite edges joined to opposite edges of the front section to accommodate a front portion of a toilet seat, a downwardly extending imperforate transverse flap joined to the front panel, said flap having a downward length to locate the flap adjacent the front of the toilet bowl to protect a person's legs and clothing from the toilet bowl and means on the sheet member to releasably retain the sheet member on the toilet seat with the flap extending downwardly adjacent the front of the toilet bowl.

13. The cover of claim 12 wherein: the sheet member is a one-piece plastic sheet.

14. The cover of claim 13 wherein: the opposite edges of the front panel and front section are heat-sealed together.

15. The cover of claim 12 wherein: the means on the sheet member is an adhesive, and cover means located over the adhesive, said cover means being removable from the adhesive whereby the adhesive can be placed in contact with the toilet seat.

16. The cover of claim 12 wherein: the opening in the sheet member is smaller than the central opening of the toilet seat.

17. The cover of claim 12 wherein: the opening in the toilet seat has a longitudinal generally keyhole shape.

18. The cover of claim 12 wherein: the opening in the toilet seat has a generally ovaloid shape.

19. The cover of claim 12 including: a transverse member secured to the flap of a size to prevent the cover from being flushed down a conventional toilet bowl.

20. The cover of claim 12 including: a second flap joined to the front section and releasably connected to the side sections adapted to extend downwardly over an inside of the toilet seat into the associated toilet bowl.

21. The cover of claim 12 including: transverse means secured to the sheet member of a size to prevent the cover from being flushed down the associated toilet bowl.

22. The cover of claim 12 including: an upwardly directed transverse flap joined to the rear section of the sheet member.

* * * * *